US012371951B2

(12) United States Patent
Peters et al.

(10) Patent No.: US 12,371,951 B2
(45) Date of Patent: Jul. 29, 2025

(54) DOWNHOLE COMPONENT HAVING A VARIABLE BENDING STIFFNESS

(71) Applicant: Baker Hughes Oilfield Operations LLC, Houston, TX (US)

(72) Inventors: Volker Peters, Celle (DE); Paul Madero, Cypress, TX (US); Sven Krueger, Winsen (DE); Andreas Peter, Celle (DE); Christian Fulda, Sehnde (DE)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 0 days.

(21) Appl. No.: 18/640,933

(22) Filed: Apr. 19, 2024

(65) Prior Publication Data

US 2024/0352808 A1 Oct. 24, 2024

Related U.S. Application Data

(60) Provisional application No. 63/461,076, filed on Apr. 21, 2023.

(51) Int. Cl.
*E21B 17/07* (2006.01)

(52) U.S. Cl.
CPC ..... *E21B 17/073* (2013.01)

(58) Field of Classification Search
CPC ..... E21B 17/20; E21B 17/073
See application file for complete search history.

(56) References Cited

U.S. PATENT DOCUMENTS

| | | | | |
|---|---|---|---|---|
| 9,631,476 | B2 | 4/2017 | Chang et al. | |
| 9,696,198 | B2 | 7/2017 | Turner et al. | |
| 9,803,426 | B2 | 10/2017 | Menger et al. | |
| 9,945,190 | B2 | 4/2018 | Crowley et al. | |
| 11,643,883 | B1 * | 5/2023 | Hardin | E21B 17/20 166/61 |

(Continued)

FOREIGN PATENT DOCUMENTS

| | | | |
|---|---|---|---|
| EP | 4063050 | A1 | 9/2022 |
| WO | 2009039448 | A2 | 3/2009 |
| WO | 2021050334 | A1 | 3/2021 |

OTHER PUBLICATIONS

International Search Report & Written Opinion for International Application No. PCT/US2024/025387, International Filing Date Apr. 19, 2024, Aug. 5, 2024, 9 pages.

(Continued)

*Primary Examiner* — Shane Bomar
(74) *Attorney, Agent, or Firm* — CANTOR COLBURN LLP

(57) ABSTRACT

An embodiment of a coupling device is configured to be disposed in a borehole string in a borehole in a subterranean region. The coupling device includes a coupler body having a longitudinal axis, the coupler body including an elongated shaft extending along the longitudinal axis and configured to carry loads through the coupling device, a stiffness control device connected to the elongated shaft, the stiffness control device configured to adjust a bending stiffness of the coupler body, and an actuator configured to cause the stiffness control device to adjust the bending stiffness of the coupler body.

20 Claims, 8 Drawing Sheets

(56) References Cited

U.S. PATENT DOCUMENTS

| | | | | |
|---|---|---|---|---|
| 2005/0161261 | A1* | 7/2005 | Betts | E21B 7/30 175/73 |
| 2005/0211471 | A1 | 9/2005 | Zupanick | |
| 2008/0007056 | A1* | 1/2008 | Beesley | E21B 43/0107 285/321 |
| 2010/0139977 | A1 | 6/2010 | Watkins et al. | |
| 2011/0308858 | A1* | 12/2011 | Menger | E21B 17/05 403/113 |
| 2015/0101800 | A1* | 4/2015 | Chang | E21B 49/08 166/381 |
| 2015/0226020 | A1* | 8/2015 | Crowley | E21B 47/12 175/74 |
| 2017/0350192 | A1 | 12/2017 | Sadabadi et al. | |
| 2019/0284882 | A1 | 9/2019 | Peters | |
| 2020/0018377 | A1 | 1/2020 | Hohl et al. | |
| 2021/0079736 | A1* | 3/2021 | Reckmann | F16F 15/129 |
| 2021/0079738 | A1 | 3/2021 | Peters et al. | |
| 2021/0079976 | A1 | 3/2021 | Hohl et al. | |
| 2024/0352799 | A1* | 10/2024 | Peter | E21B 7/06 |

OTHER PUBLICATIONS

Murphey et al., "Hole Deviation and Drill String Behavior"; Society of Petroleum Engineers Journal; SPE 1259; Jul. 13, 1965; 11 pages.

Prasetyo et al., "Optimization of Drillstring to Produce More Stable Dynamic Drilling on Horizontal Drilling by Applying Different Stiffness Combinations"; Journal of Earth Energy Science, Engineering, and Technology, vol. 2, No. 2, 2019; 9 pages.

* cited by examiner

DOWNHOLE COMPONENT HAVING A VARIABLE BENDING STIFFNESS

This application claims the benefit of U.S. Provisional Patent Application Ser. No. 63/461,076 filed Apr. 21, 2023.

BACKGROUND

In the resource recovery and fluid sequestration industry, various types of drill strings are deployed in a borehole for purposes such as exploration and production of hydrocarbons. A drill string generally includes drill pipe or other tubular and a bottomhole assembly (BHA). Drill strings are increasingly used to drill boreholes that have curved, deviated and lateral sections. Typically, such boreholes are drilled using multiple BHAs. For example, vertical and lateral sections of a borehole are drilled using a relatively stiff BHA, and curved sections are drilled by removing the stiff BHA and deploying a flexible BHA.

SUMMARY

An embodiment of a coupling device is configured to be disposed in a borehole string in a borehole in a subterranean region. The coupling device includes a coupler body having a longitudinal axis, the coupler body including an elongated shaft extending along the longitudinal axis and configured to carry loads through the coupling device, a stiffness control device connected to the elongated shaft, the stiffness control device configured to adjust a bending stiffness of the coupler body, and an actuator configured to cause the stiffness control device to adjust the bending stiffness of the coupler body.

An embodiment of a method to adjust a bending stiffness of a coupler disposed in a borehole includes deploying a borehole string in the borehole in a subterranean region, the borehole string including the coupler, the coupler having a longitudinal axis, the coupler including an elongated shaft extending along the longitudinal axis and configured to carry loads through the coupler, where a stiffness control device is connected to the elongated shaft. The method also includes controlling at least one of an inclination of the coupler and a rotational speed of the coupler, and causing the stiffness control device to adjust the bending stiffness of the coupler in response to the controlling.

BRIEF DESCRIPTION OF THE DRAWINGS

The following descriptions should not be considered limiting in any way. With reference to the accompanying drawings, like elements are numbered alike.

DETAILED DESCRIPTION

Figure 1:
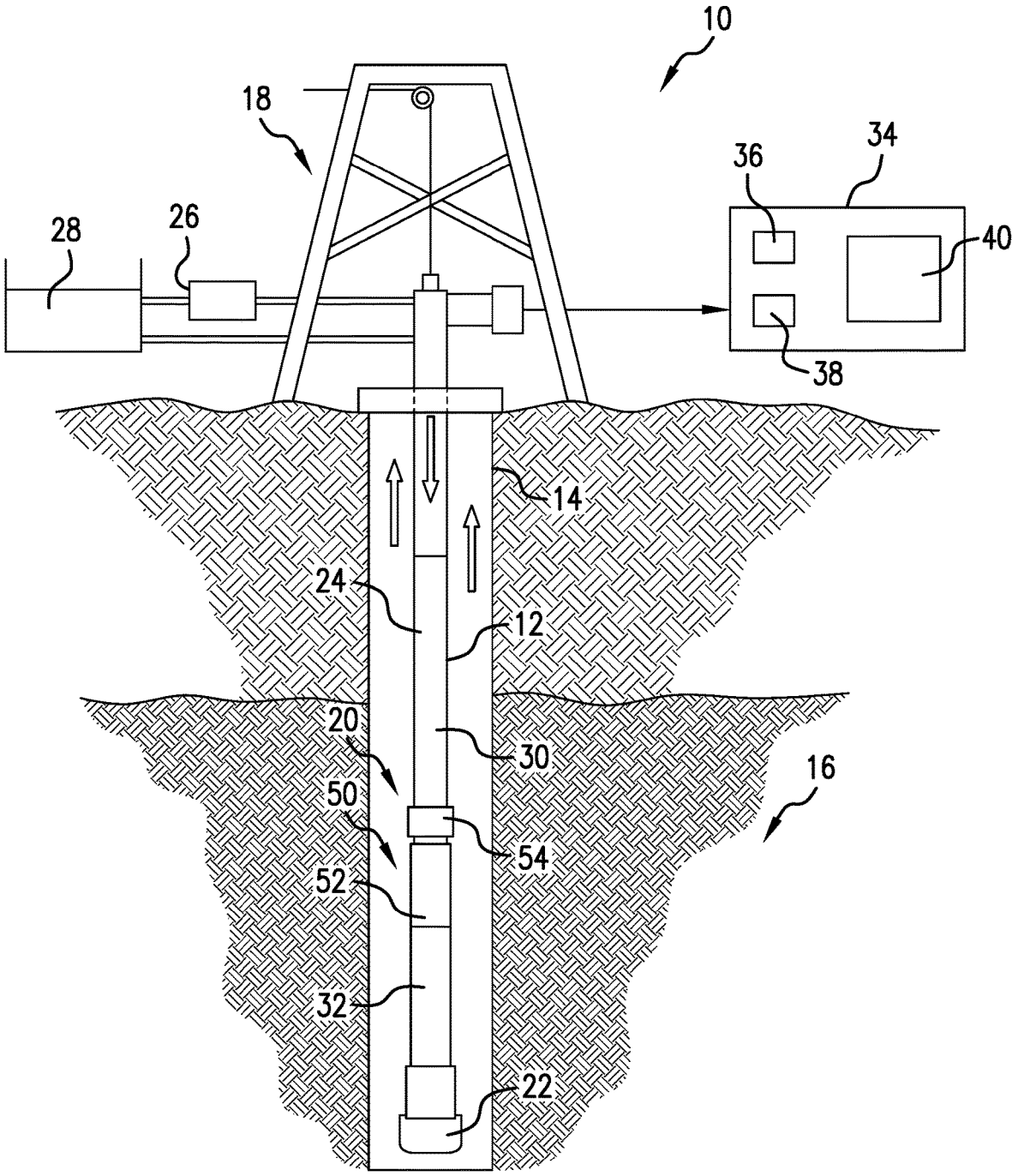
FIG. 1 depicts an embodiment of a drilling and/or formation measurement system including a coupler having a variable bending stiffness.

A detailed description of one or more embodiments of the disclosed apparatus and method are presented herein by way of exemplification and not limitation with reference to the Figures.

Devices, systems and methods are providing for performing subterranean operations (e.g., drilling operations) using one or more components that have a variable bending stiffness. An embodiment of a downhole component includes an internal control element configured to provide a variable bending flexibility or bending stiffness to the component. In an embodiment, the downhole component is a flexible coupler or collar that has a bending stiffness that can change in response to changes in operating parameters, such as rotational speed and inclination.

The downhole component also includes an actuating element (also referred to as an actuator) that automatically controls the control element in response to a selected operational parameter or a change in an operational parameter. The actuating element includes a mechanical device that moves or otherwise reacts to a force that is applied to the device due to the operational parameter. The device is configured to react and control the control element without an electronic controller and without the need for active control (e.g., commands from an electronic device or operator).

In an embodiment, the control element is attached or fixedly disposed relative to a flexible element (e.g., a shaft, or other elongated body) in the coupler body, and includes a hydraulically controlled system having opposing hydraulic devices connected by a hydraulic fluid flow line. The hydraulic flow line includes or is connected to a restriction that is provided by a variable nozzle, valve or other suitable flow control device or mechanism. The control element is actuated or controlled by the actuator to adjust a size of the restriction, and thereby adjust the bending flexibility.

In an embodiment, the actuator is a centrifugal force device (i.e., a device that reacts to centrifugal forces due to rotation of the coupler), which is operably connected to the control element. An example of a centrifugal force device is a centrifugal governor. The centrifugal force device automatically opens, closes or adjusts the size of the restriction in response to a centrifugal force that corresponds to a given rotational speed. In an embodiment, the actuator is a gravity device or gravity adjuster configured to react to a gravitational force when the coupler is in an inclined or deviated orientation.

Embodiments described herein provide a number of advantages and technical effects. The systems described herein provide effective mechanisms for adjusting the bending flexibility of a drilling assembly or drill string to facilitate drilling boreholes with desired curvatures and inclinations. The systems allow for adjusting bending stiffness as needed to drill both curved and straight (e.g., horizontal or deviated) borehole sections. The systems described herein can produce curved sections with high curvature (low radius), drill straight sections with reduced or minimal deflections, and adapt to conditions and features of a subterranean region (e.g., formation boundaries and stringers). In addition, the embodiments provide for drilling both straight and curved sections with a single assembly, reducing or eliminating the need to change out a drilling assembly. Furthermore, the systems described herein can automatically adjust bending stiffness in response to downhole conditions without the need for active control or control from the surface, and without complex sensor-based control devices. Flexibility can also be provided to compensate for undesirable vibrations (such as axial, lateral, or torsional vibrations, e.g., stick/slip and high frequency oscillations).

Typical drilling operations use a stiff drilling assembly for drilling straight sections, and switch over to a flexible drilling assembly for drilling curved sections, which results in multiple round trips. The embodiments described herein can be used in a drilling operation to drill both curved and lateral sections of a borehole in a single run, and are capable of being adjusted to drill curves with small radii (e.g., 15 degree/foot change in inclination or azimuth), and drill straight sections with minimal deflections. Accordingly, the embodiments present a more cost-effective solution than existing drilling systems.

FIG. 1 shows an embodiment of a system 10 for performing a subterranean operation (e.g., drilling, measurement, stimulation and/or production). The system 10 includes a borehole string 12 that is shown disposed in a well or borehole 14 that penetrates a subterranean region 16 (including, for example, at least one earth formation).

The borehole string 12 is operably connected to a surface structure or surface equipment 18 such as a drill rig, which includes or is connected to various surface components. In an embodiment, the borehole string 12 is a drill string including one or more drill pipe sections that extend downward into the borehole 14, and is connected to various downhole components, all or some of which may be incorporated in a bottomhole assembly (BHA) 20.

The BHA 20 includes a drill bit 22, which may be driven from the surface by a surface drive or rotary table, or driven by a downhole mud motor 24. The surface equipment 18 includes components to facilitate circulating fluid such as drilling mud through the borehole string 12 and an annulus between the borehole string 12 and a wall of the borehole 14. For example, a pumping device 26 is located at the surface to circulate the fluid from a mud pit or other fluid source 28 into the borehole 14 as the drill bit 22 is rotated. The borehole string 12 is discussed as a drill string 12, but is not so limited and can be any type of borehole string (e.g., string for hydraulic fracturing and/or other stimulation, wireline string, wellbore intervention string, fishing string, milling string, etc.)

The system 10 may include one or more of various downhole components configured to perform selected functions downhole such as controlling drilling, controlling drilling direction, performing downhole measurements, facilitating communications, performing stimulation operations and/or performing production operations. For example, the downhole components include a logging while drilling (LWD) or measurement while drilling (MWD) tool 30, the mud motor 24, a steering or directional control system 32 (e.g., a rotary steerable system), and other components such as a stabilizers and/or vibration damping devices.

Other components may include a telemetry assembly such as a mud pulse telemetry (MPT) assembly, for communicating with the surface and/or other downhole tools or devices. The telemetry assembly includes, for example, a pulser that generates pressure signals through the fluid.

One or more downhole components and/or one or more surface components may be in communication with and/or controlled by a processor such as a downhole processor and/or a surface processing unit 34. The surface processing unit 34 may control various parameters such as rotary speed, weight-on-bit, fluid flow parameters (e.g., pressure and flow rate) and others. The surface processing unit 34, in one embodiment, includes an input/output (I/O) device 36, a processor 38, and a data storage device 40 (e.g., memory, computer-readable media, etc.).

The system 10 includes at least one component 50 having a variable bending flexibility and stiffness. The component 50 operates to transition between different stiffnesses to facilitate drilling along a desired path, and may also be operated or used to dampen undesirable vibrations. The component 50 is described herein as a coupler 50 configured to connect components of the drill string 12. Description of the component 50 as a coupler is not intended to limit the component 50 to any particular type of downhole component or position in the drill string 12.

The coupler 50 includes a coupler body 52 that supports a flexibility control system configured to adjust the bending stiffness of the coupler 50. The bending flexibility or stiffness is related to an amount of bending exhibited by the coupler 50 in response to lateral forces. The coupler 50 may include additional components such as a stabilizer 54.

Figure 2:
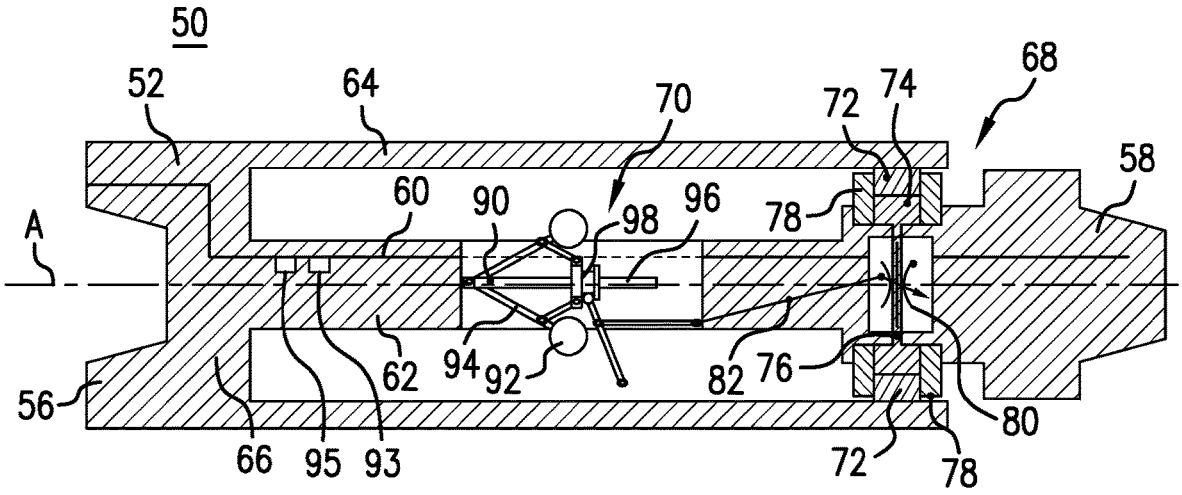
FIG. 2 depicts an embodiment of a coupler having a variable bending stiffness, the coupler including an actuator configured to control or actuate a stiffness control device, the actuator configured to automatically react to a centrifugal force due to rotation of the coupler.

FIG. 2 depicts an embodiment of the coupler 50, which includes a coupler body 52 having a longitudinal axis A. The coupler 50 can be connected to other components (e.g., the directional control system 32, the MWD or LWD tool 30, etc.) via any suitable connection mechanism. For example, the coupler 50 includes a box connector 56 having internal threading, and a pin connector 58 having external threading. The coupler body 52 may include a bore or conduit (not shown) for transmitting fluid (e.g., drilling mud and/or formation fluid).

The coupler body 52 may be configured to relay power and/or communications transmitted through a borehole string. For example, the coupler 50 includes an internal bore or conduit 60 for an electrical connection (e.g., wire or cable) or other connection (e.g., fiber optic).

The coupler body 52 also includes an internal flexible element 62, which may be an elongated body that extends axially (in a direction of the axis A) and is mechanically connected to the coupler body 52. The flexible element 62 may be a steel or aluminum shaft (or a shaft made from any suitable material) that has a flexibility based on material properties of the shaft and geometric properties (e.g., length and diameter). The flexible element 62 is configured to carry a drilling load (e.g., weight, bending and torsion) from an uphole connector (e.g., the box connector 56) to a downhole connector (e.g., the pin connector 58).

The coupler body 52 and the flexible element 62 may be formed as a unitary body, or the flexible element 62 may be a separate component attached to the coupler body 52. The coupler 50 and/or components thereof can be manufactured by machining (e.g., milling and turning), casting, additive manufacturing (e.g., 3D printing) and/or other suitable process.

For example, the coupler body 52 defines a sleeve 64 that is integrally formed with the flexible element 62 or is connected to the flexible element 62 by a connecting element 66, such that one end of flexible element 62 is fixedly attached to the sleeve 64. An opposing end of the flexible element 62 is not fixedly attached to the sleeve 64. In this way, the flexible element 62 can flex or deform to allow the coupler 50 to bend. The sleeve 64 may be significantly less flexible than the flexible element 62.

The flexible element 62 may be a rigid body that is attached to, or integral with, the coupler body 52, as shown in FIG. 2. Alternatively, the connecting element may be a flexible body or an articulated body (e.g., a cardan joint or Hooke's joint). For example, the flexible element 62 can be a rigid body connected to the coupler body 52 via a joint that allows the rigid body to deflect toward the sleeve.

The coupler body 52 also includes a stiffness control device, referred to as a control element 68, that is controllable to adjust a bending flexibility of the coupler 50 by controlling an extent to which the flexible element 62 can deform or bend toward the sleeve 64. The control element 68 is controlled by an actuator 70 that reacts to a downhole condition to adjust the control element 68.

In an embodiment, the control element 68 is a hydraulically controlled device that includes opposing hydraulic devices connected by a hydraulic fluid flow line. In an embodiment, the hydraulic devices include opposing hydraulic chambers defined by pistons 72 and containers 78. The hydraulic chambers are connected by a hydraulic fluid flow line 76. A hydraulic fluid 74 fills the chambers and the flow line 76. The relative sizes and shapes of the containers 78 and the pistons 72 are selected to maintain a fluid tight seal therebetween. The containers 78 and the pistons 72 may be cylindrical, but are not so limited.

When the hydraulic fluid 74 is free to flow between the chambers, the control element 68 allows the flexible element 62 (or the end of the flexible element proximate to the pistons 72) to deflect relative to the sleeve 64. When the flexible element 62 deflects, one piston 72 moves laterally in the direction of the deflection and another piston 72 moves laterally in the opposite direction.

Embodiments are not limited to a piston system described herein, and may utilize any hydraulic system in which hydraulic fluid flow can be controlled to affect flexibility. For example, the control element 68 may feature hydraulic pillows, bellows, bags or any other suitable device or component.

The control element 68 also includes a device for restricting flow through the hydraulic flow line 76 or otherwise controlling the flow rate by which hydraulic fluid can flow between the chambers. The device is provided to establish and/or adjust a size of a restriction in the hydraulic flow line 76. In an embodiment, the device is a valve or nozzle 80, such as an adjustable nozzle, that is operably connected to the actuator 70 by a linkage 82 (e.g., a mechanical linkage) that transmits a force applied by the actuator 70 to adjust the valve or nozzle 80.

For example, when the valve or nozzle 80 is fully open (in an open state in which there is no restriction or the restriction has a maximum size), the flexible element 62 is free to deflect and the coupler 50 has a low or minimum bending stiffness (high or maximum bending flexibility). When the valve or nozzle 80 is fully closed (in a closed state, in which there is full restriction or the restriction has a minimum size), the pistons 72 prevent or reduce such deflection and the coupler 50 has a high or maximum bending stiffness (low or minimum bending flexibility). In some embodiments, the valve or nozzle 80 can be adjusted to one or more intermediate states in which the bending stiffness is between the maximum and minimum stiffnesses.

The actuator 70, in an embodiment, includes an actuation device that is responsive to one or more forces generated by rotation of the coupler 50. For example, the actuator 70 includes a centrifugal governor 90. The centrifugal governor 90 may be located centrally (along the flexible element 62) as shown, or positioned at any suitable location such that rotational speed and centrifugal forces cause a change in the size of the restriction.

The centrifugal governor 90 may include two masses 92 (e.g., spheres or balls) that are connected by lever arms 94 to a central rotating shaft 96. The central rotating shaft 96 is coupled to the flexible element 62, the connecting element 66 or any other component of the coupler 50 so that rotation of the coupler 50 is transmitted to the central rotating shaft 96.

The centrifugal governor 90 reacts to centrifugal forces resulting from rotation of the coupler 50. The centrifugal forces cause the masses 92 to move laterally, which in turn causes a sliding sleeve 98 to move axially. The axial movement is translated by the linkage 82, which causes a corresponding change in the size of the valve or nozzle 80 (or other restriction).

When a threshold rotational speed is reached, the masses 92 move outwardly and pull or otherwise move the linkage 82 to close the valve or nozzle 80 and prevent fluid flow between the chambers. In this way, the rotational speed can be increased to cause the coupler 50 to have the maximum stiffness. When the rotational speed is reduced below the threshold, the masses 92 move inwardly and the valve or nozzle 80 opens to provide bending flexibility.

In an embodiment, the centrifugal governor 90 is operable to adjust the nozzle to one or more intermediate states in which the restriction is smaller than in the fully open state, and the flow rate allowed through the hydraulic flow line 76 is reduced. The reduced flow rate results in the pistons 72 being more resistant to deflection of the flexible element 62, which results in a reduced bending flexibility. For example, the centrifugal governor 90 controls the restriction size as a function of rotational speed, allowing the bending stiffness to be adjusted gradually or proportional to the rotational speed.

In an embodiment, the actuator 70 is configured so that there is a minimum speed threshold (and resulting minimum centrifugal force threshold) reached before the actuator moves the nozzle or other restricting device. For example, the centrifugal governor 90 may be configured to so that the centrifugal governor 90 does not apply any force or otherwise actuate the valve or nozzle 80 until a threshold rotational speed (a minimum speed) is reached. This may be accomplished by including a biasing device (e.g., a spring) having a spring stiffness selected based on the desired threshold centrifugal force.

While some embodiments in this disclosure include a central governor 90 for the actuator 70, the embodiments are not so limited. For example, as shown in FIG. 2, the actuator 70 may feature a sensor 93 for rotational velocity that sends data to a processor 95 (for example, by conduit 60). The processor 95 may be able to control an electrical or hydraulic actuator 70 to actuate to restrict flow of hydraulic fluid 74 through flow line 76 to ultimately restrict movement of pistons 72 and sleeve 64 relative to flexible element 62. The sensor 93 and the processor 95 may be provided in addition to the central governor 90, or as an alternative to the central governor 90.

Figure 3:
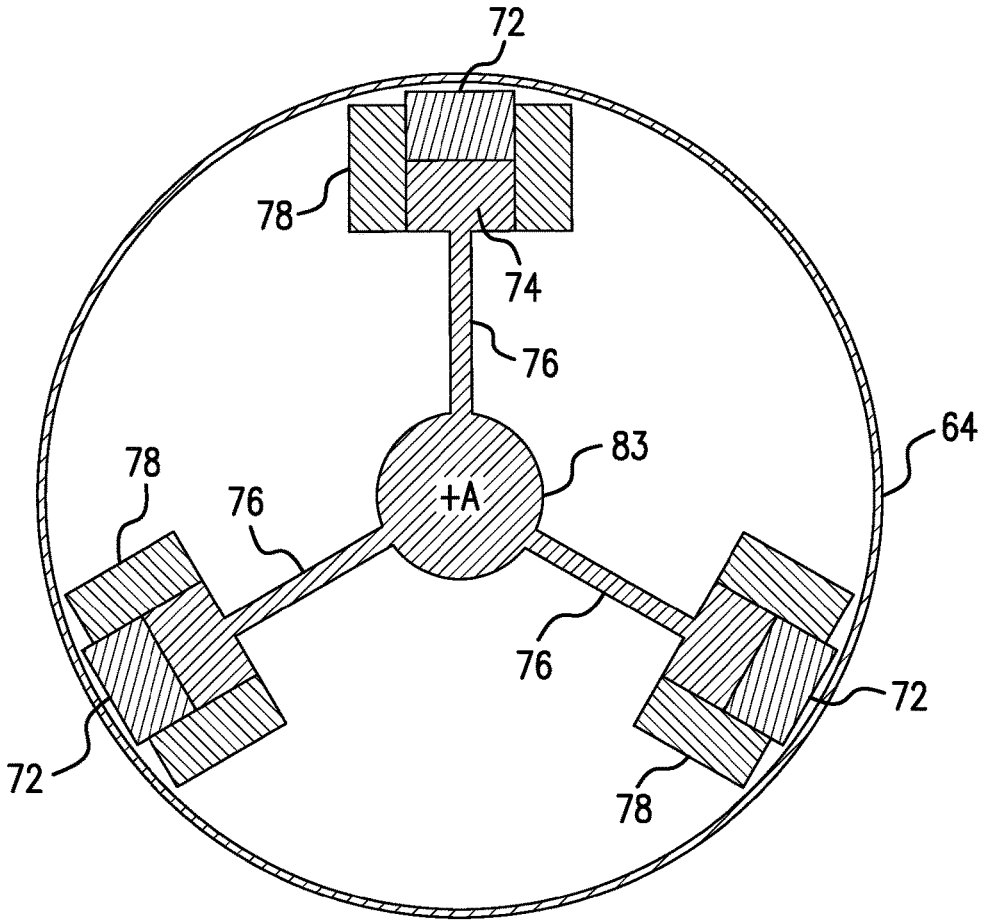
FIG. 3 is a cross-sectional view of an embodiment of a coupler having a variable bending stiffness, the cross-sectional view being perpendicular to a longitudinal axis A, the coupler including a control element with three connected containers that are connected via a manifold valve.

FIG. 3 shows a cross section of the coupler 50 that is perpendicular to the longitudinal axis A, in an alternative embodiment. In this embodiment, three containers 78 are disposed adjacent to the sleeve 64. Each of the containers 78 includes a piston 72 and a hydraulic fluid 74 that is in hydraulic contact with the hydraulic fluid 74 in the other containers 78 via flow lines 76 and a manifold valve 83. The manifold valve 83 is configured to close or reduce (i.e., restrict) the flow of hydraulic fluid 74 through all three flow lines 76 by hydraulically disconnecting the three flow lines 76 from each other. By restricting the flow of hydraulic fluid 74 in this way, the resistance of the pistons 72 and the sleeve 64 against movement increases, which leads to an increase of the stiffness of coupler 50. Likewise, if the manifold valve 83 opens or increases the flow of hydraulic fluid 74 through the flow lines 76 by again hydraulically connecting the three flow lines 76, the resistance of the pistons 72 and the sleeve 64 against movement decreases, which leads to a decrease of the stiffness of coupler 50. The sleeve 64 may be supported by even more pistons, such as four or more pistons that may be distributed about the circumference of the sleeve 64. Supporting the sleeve 64 with more than two pistons has advantages since the sleeve 64 is more equally supported by more pistons and the risk is reduced that the sleeve 64 and the coupler 50 bend in a direction that lays between two of the supporting pistons 72.

Figure 4A:
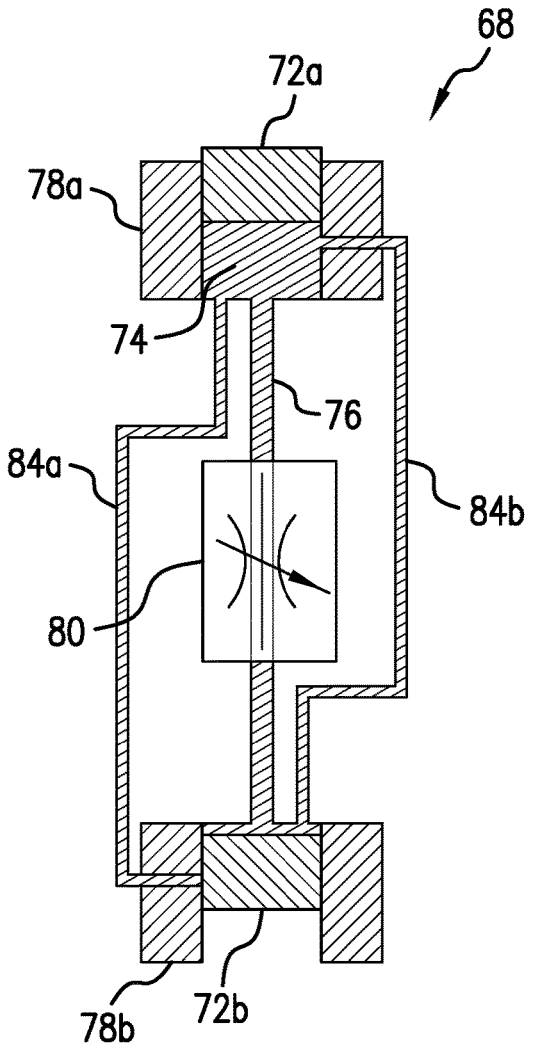
FIGS. 4A and 4B show an alternative embodiment of the control element of FIG. 2 with two additional hydraulic shortcut lines.
Figure 4B:
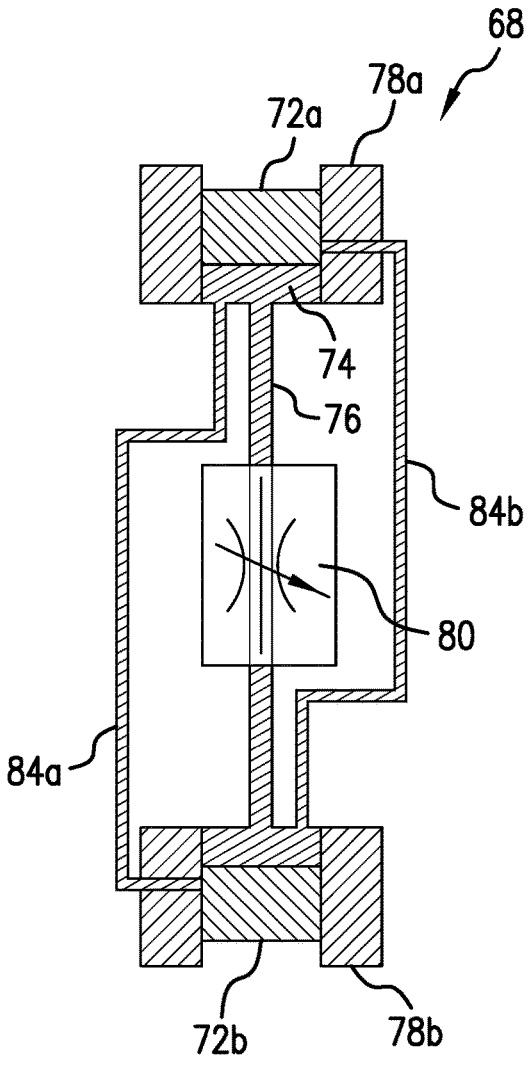

FIGS. 4A and 4B show an alternative embodiment of the control element 68, in which the control element features additional hydraulic shortcut lines 84*a* and 84*b*. Similar to the flow lines 76, the hydraulic shortcut lines 84*a* and 84*b* connect corresponding containers 78*a* and 78*b* that respectively include pistons 72*a* and 72*b*. The hydraulic shortcut lines 84*a* and 84*b* are arranged at different locations in the containers 78*a* and 78*b*. For example, the hydraulic shortcut line 84*b* ends at a first location of the container 78*a* and the hydraulic shortcut line 84*b* ends at a second location of the container 78*a*. The first and second locations are selected in a way that the hydraulic shortcut lines 84*a* and 84*b* can be controlled (e.g., restricted or even closed) by the movement of the pistons 72*a*, 72*b*.

FIG. 4A shows a situation in which the piston 72*a* is fully extracted (i.e., the volume of hydraulic fluid 74 in the container 78*a* is at a maximum) and the piston 72*b* is fully retracted (i.e., the volume of hydraulic fluid 74 in the container 78*b* is at a minimum) in response to the movement of the sleeve 64 relative to the flexible element 62. If, in this situation (or in a situation where the piston 72*a* is fully retracted and the piston 72*b* is fully extracted), the flow line 76 is closed by the valve or nozzle 80, it is not desired that the pistons 72*a* and 72*b* immediately stop their movement, as this could cause the sleeve 64 to remain in the deflected position, which might cause damage to the sleeve 64 when drilling progresses. To avoid this, the hydraulic shortcut lines 84*a* and 84*b* allow some more movement of pistons 72*a* and 72*b* even when the valve or nozzle 80 is closed, until both pistons 72*a* and 72*b* are between a fully extracted and a fully retracted position as shown in FIG. 4B.

For example, if in the situation of FIG. 4A, the valve or nozzle 80 is closed, the piston 72*a* may still be movable as the hydraulic fluid 72 is able to enter the hydraulic shortcut line 84*b* at the first location and flow to the piston 72*b* which may also move in response to the movement of piston 72*a*. This movement only stops when the piston 72*a* covers and closes hydraulic shortcut line 84*b* to restrict or prevent flow of hydraulic fluid 74 through hydraulic shortcut line 84*b* (FIG. 4B). In this situation, the hydraulic shortcut line 84*a* is also controlled or restricted by the piston 72*b*, and further movement of pistons 72*a* and 72*b* is prevented as the flow line 76 as well as both hydraulic shortcut lines 84*a* and 84*b* are covered and closed on respective ends by the respective pistons 72*b* and 72*a*. Thus, the hydraulic shortcut lines 84*a* and 84*b* allow movement of the pistons 72*a* and 72*b* to stop only if both pistons 72*a* and 72*b* are neither in a fully extracted nor in a fully retracted position.

Figure 5:
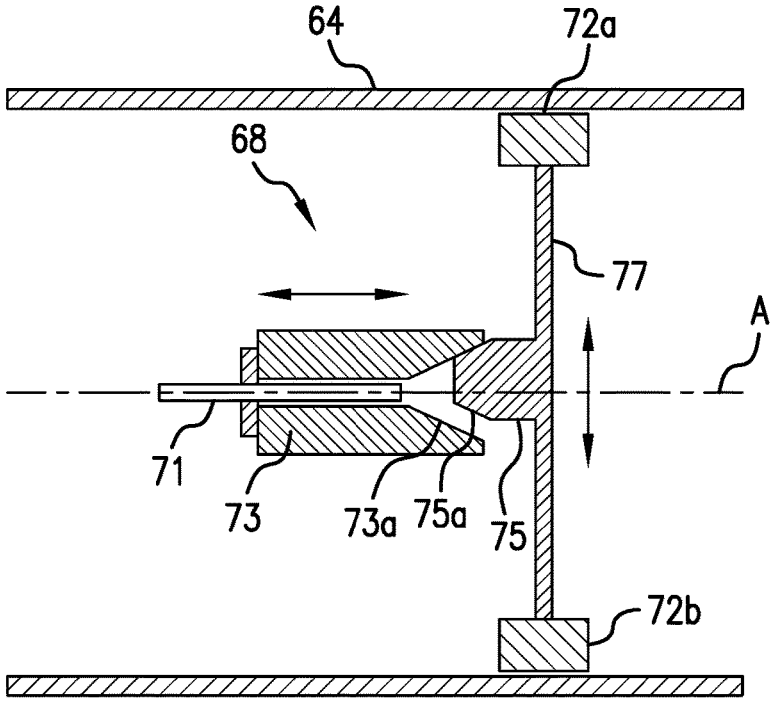
FIG. 5 shows an alternative embodiment of the control element of FIG. 2 with a rigid connection between the pistons.

FIG. 5 shows an alternative embodiment of the control element 68, in which the hydraulic connection between the pistons 72*a* and 72*b* is replaced by a rigid connection 77 (e.g., a rod). The rigid connection 77 is fixedly connected to a restriction element 75 that may have a conical surface 75*a* on one side. The actuator 70 may be fixedly connected to a shaft 71 that in turn is fixedly connected to a guiding sleeve 73. The guiding sleeve 73 may have a receiving conical surface 73*a* on one side that is arranged and shaped to receive and match the conical surface 75*a* of the restriction element 75 when the actuator 70 moves the guiding sleeve 73 closer to the restriction element 75. When the distance of the conical surface 75*a* of the restriction element 75 and the receiving conical surface 73*a* of the guiding sleeve 73 becomes more and more small, the less the restriction element 75, the rigid connection 77, and the pistons 72*a* and 72*b* are able to move relative to the sleeve 64 in a direction that is perpendicular to the longitudinal axis A. Thus, moving the guiding sleeve 73 towards the restriction element 75 by the actuator 70 restricts the deflection of the sleeve 64 with respect to the flexible element 62, ultimately increasing the stiffness of coupler 50.

Figure 6:
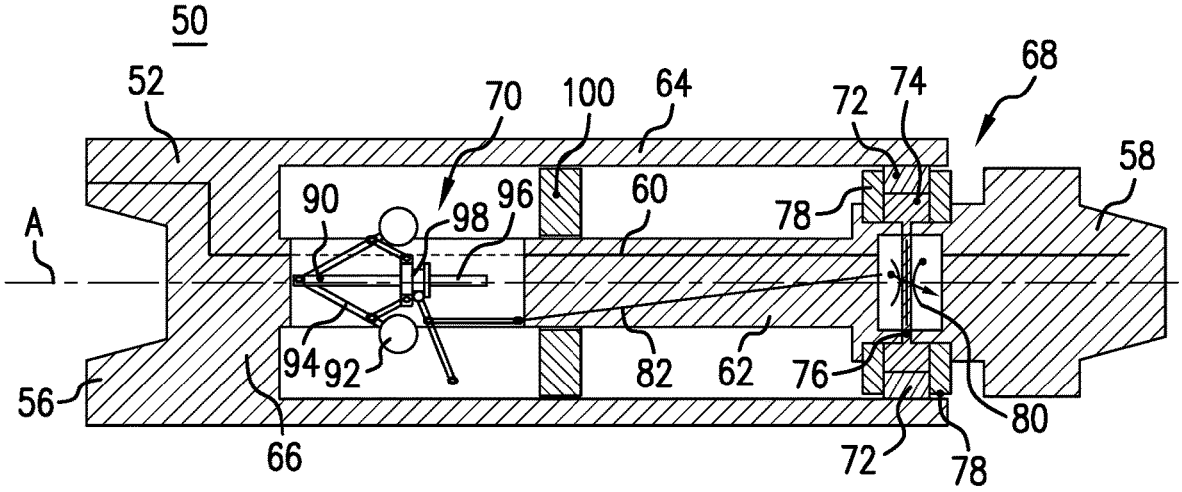
FIG. 6 depicts the coupler of FIG. 2, including a centralizer.

FIG. 6 depicts an embodiment of the coupler 50, which includes all of the components of the embodiment of FIG. 2. In the embodiment of FIG. 6, the coupler 50 includes a centralizer 100. The centralizer 100 may be located in an axially central location between the connecting element 66 and the control element 68. The centralizer 100 may be a rigid body that engages the flexible element 62 and/or the sleeve 64 when the coupler 50 is bent, or a flexible body having a selected flexibility. The centralizer 100 acts to modify an initial flexibility (i.e., flexibility when the control element is not engaged) and provides an internal support to limit the flexibility and prevent overload conditions.

Figure 7A:
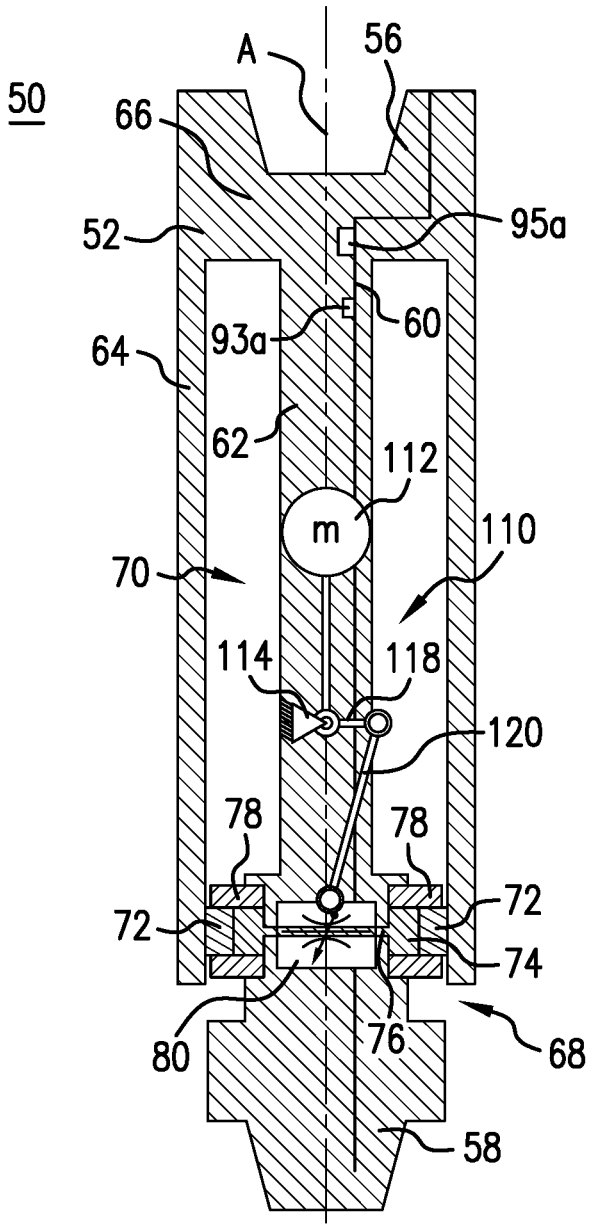
FIGS. 7A and 7B depict an embodiment of a coupler having a variable bending stiffness, the coupler including an actuator configured to automatically control or actuate a stiffness control device based on an inclination of the coupler.
Figure 7B:
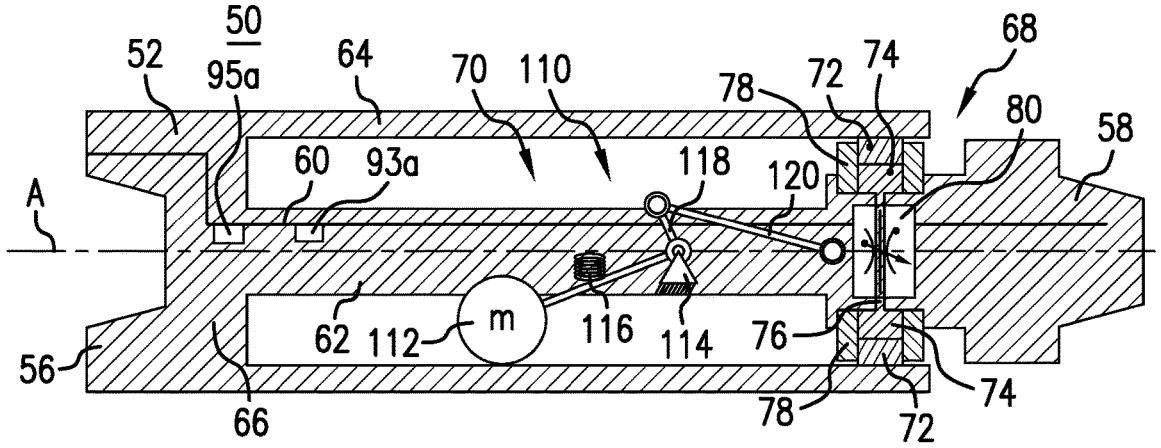

FIGS. 7A and 7B depict an embodiment of the coupler 50, in which the actuator 70 is affected by gravity and reacts to changes in inclination. In this embodiment, the coupler 50 includes the coupler body 52 and the control element having the valve or nozzle 80, the hydraulic flow line 76, and opposing chambers defined by the pistons 72 and the containers 78.

The actuator 70 includes a gravity adjuster 110 that is configured to react in response to gravitational force when an inclination of the coupler 50 changes or the coupler is at a selected inclination. It is noted that the gravity adjuster 110 (or other actuation mechanism reactive to inclination) may be provided in addition to an actuation mechanism reactive to rotational speed (e.g., the governor 90), or as an alternative to an actuation mechanism reactive to rotational speed.

The gravity adjuster 110 may include a mass 112 (e.g., a ball) connected to a fulcrum 114 that is fixedly disposed on the flexible element 62. The fulcrum 114 may be a component attached to the flexible element 62 or integral with the flexible element 62.

The mass 112 is connected to the fulcrum 114 by a rotatable linking assembly 118 having orthogonal members that are connected to the fulcrum 114 and are rotatable with the fulcrum 114 as a pivot point. The linking assembly 118 is connected to the adjustable valve or nozzle 80 via a mechanical linkage 120, configured so that rotation of the linking assembly 118 is translated to close the valve or nozzle 80 or reduce the size of the valve or nozzle 80 (increase the restriction).

The gravity adjuster 110 is configured to react to a change in inclination by allowing the mass 112 to move downward due to gravitational force (e.g., rotate such that the mass moves toward a lower side of the sleeve) when the coupler 50 is steered to a deviated orientation. For example, when the coupler 50 is vertically oriented, the gravity adjuster 110 is in a neutral state (the actuator does not affect the control element 68 and the valve or nozzle 80 is fully open) as shown in FIG. 7A. Inclining the coupler 50 to a deviated or horizontal orientation causes the mass 112 the move the mechanical linkage 120 and fully close the valve or nozzle 80 so that fluid cannot flow between the chambers. FIG. 7B shows the coupler 50 oriented horizontally and having maximum bending stiffness.

In an embodiment, the gravity adjuster is configured to gradually open the valve or nozzle 80 (or otherwise open the nozzle in a controlled manner) as a function of the inclination. For example, a spring or other biasing device 116 may be included so that the mass 112 moves by an amount that is proportional to, or otherwise a function of, the level of inclination. The biasing device 116 may also be configured to provide a minimum or threshold inclination that must be reached before the gravity adjuster 110 moves the valve or nozzle 80. For example, a spring or other biasing device having a selected spring stiffness may be included to bias the mass 112.

While some embodiments include a gravity adjuster 110 for the actuator 70, the embodiments are not so limited. For example, as shown in FIG. 7B, the actuator 70 may feature a sensor 93*a* for inclination or direction of gravity that sends data to a processor 95*a* (for example, by the conduit 60). The processor 95*a* may be able to control an electrical or hydraulic actuator 70 to actuate to restrict flow of hydraulic fluid 74 through the flow line 76 to ultimately restrict movement of the pistons 72 and the sleeve 64 relative to flexible element 62. The sensor 93*a* and the processor 95*a* may be provided in addition to the gravity adjuster 110, or as an alternative to the gravity adjuster 110.

It is noted that, although the above embodiments feature a single control element and actuator system, the embodiments are not so limited. For example, the coupler 50 may include multiple pairs of an actuator 70 and a control element 68, or include a single actuator 70 that controls multiple control elements 68 arrayed axially along the coupler 50. In addition, any number of couplers 50 may be included in the borehole string 12, for example, by connecting two or more couplers directly to each other, or by distributing multiple couplers along the borehole string.

Figure 8:
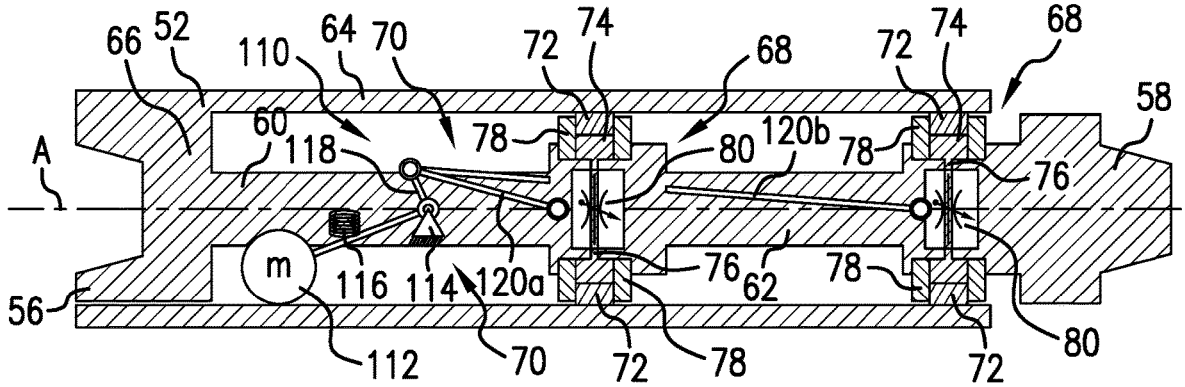
FIG. 8 depicts an embodiment of a coupler having a variable bending stiffness, the coupler including an actuator configured to automatically control or actuate a plurality of stiffness control devices.

For example, FIG. 8 shows an embodiment of the coupler 50 in which the actuator 70 is in operable communication with two or more control elements 68. In this example, the actuator is the gravity adjuster 110 but is not so limited, as the actuator 70 may be the centrifugal governor 90 or a combination of both the gravity adjuster 110 and the centrifugal governor 90. The coupler 50 in this example includes two control elements 68, and the actuator 70 is connected to each control element 68 by a respective mechanical linkage 120*a* and 102*b*, such that changes in inclination or rotational speed cause each control element 68 to be controlled simultaneously. The actuator can be configured so that each control element is adjusted by the same amount (e.g., both reduce the restriction by the same extent), or be adjusted by different amounts.

Figure 9:
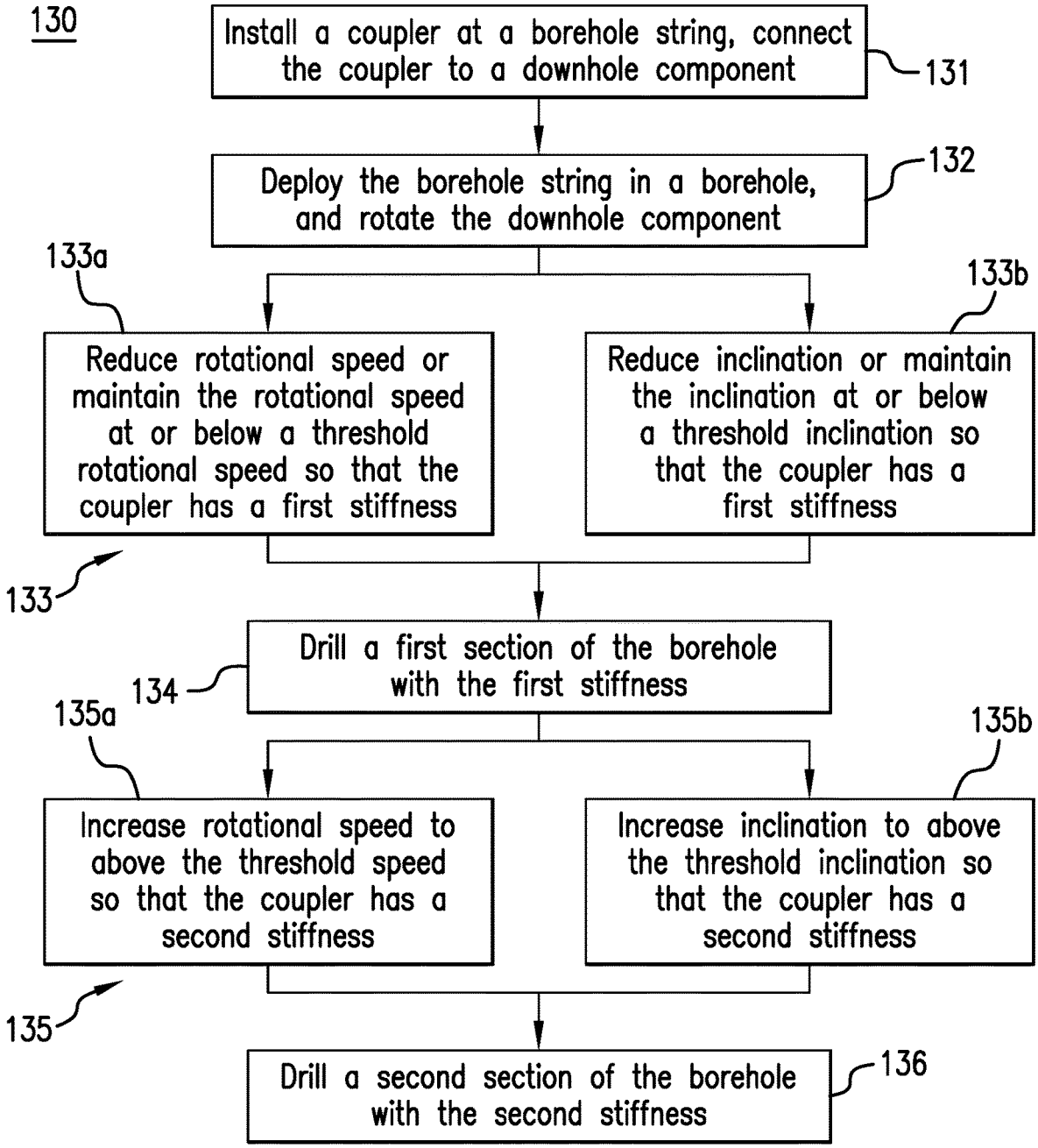
FIG. 9 is a flow diagram depicting an embodiment of a method of performing a subterranean operation, which includes controlling a bending stiffness of a coupler connected to a borehole string.

FIG. 9 illustrates a method 130 of performing a subterranean operation and controlling the bending stiffness of a downhole component or components. The method 130 may be performed in conjunction with the system 10, but is not limited thereto. The method 130 includes steps or stages represented by blocks 131-136. More specifically, in one embodiment, the method 130 includes the execution of all of the steps or stages in the order described. However, certain steps or stages may be omitted or added, or the order of the steps or stages may be changed.

At block 131, a coupler 50 is installed at a borehole string, such as the drill string 12. For example, the coupler 50 is connected at one end to a downhole component (e.g., the LWD tool 30 or the stabilizer 54) and connected at another end to another downhole component (e.g., the direction control system 32). Any number of couplers 50 may be installed at any number of locations and connected to any desired components.

At block 132, drilling is initiated by rotating a drilling assembly, and a section (e.g., a vertical section) of a borehole is drilled.

Block 133 includes blocks 133*a* and 133*b*. Either block 133*a* or 133*b* may be performed, based on whether the coupler 50 includes an actuator reactive to rotational speed or inclination. Alternatively, both blocks 133*a* and 133*b* may be performed (e.g., if the coupler 50 includes an actuator or actuators that are reactive to both changes in rotational speed and changes in inclination, or a first coupler 50 includes an actuator reactive to rotational speed and a second coupler 50 includes an actuator reactive to inclination).

At block 133*a*, if the coupler 50 includes an actuator 70 that is reactive to rotational speed, such as the centrifugal governor 90, the rotational speed of the drilling assembly is reduced or maintained at or below a selected threshold rotational speed (in RPM), so that the valve or nozzle 80 is opened and the coupler has a first bending stiffness (first bending flexibility) such as a minimum bending stiffness (maximum bending flexibility).

At block 133*b*, if the coupler 50 includes an actuator 70 that is reactive to inclination, such as the gravity adjuster 110, the inclination of the drilling assembly is reduced or maintained at or below a selected threshold inclination, so that the valve or nozzle 80 is opened and the coupler has a first bending stiffness (first bending flexibility) such as a minimum bending stiffness (maximum bending flexibility).

At block 134, a first section of the borehole is drilled with the first bending stiffness. Advantageously, this may be a curved section of the borehole. Notably, flexibility may be controlled only by controlling rotation and/or inclination; no communication with the surface, such as with processing unit 34, is needed.

In an embodiment, the bending flexibility is proportional or variable as a function of the rotational speed and/or the inclination. In this embodiment, the rotational speed and/or inclination can be reduced in a gradual or controlled manner (e.g., stepped down) to achieve a gradual or controlled increase in the bending flexibility.

Block 135 includes blocks 135*a* and 135*b*. Either block 135*a* or 135*b* may be performed, based on whether the coupler 50 includes an actuator reactive to rotational speed or inclination. Alternatively, both blocks 135*a* and 135*b* may be performed (e.g., if the coupler 50 includes an actuator or actuators that are reactive to both changes in rotational speed and changes in inclination, or a first coupler 50 includes an actuator reactive to rotational speed and a second coupler 50 includes an actuator reactive to inclination).

At block 135*a*, if the coupler 50 includes an actuator 70 that is reactive to rotational speed, such as the centrifugal governor 90, the rotational speed of the drilling assembly is increased or maintained above the selected threshold rotational speed (in RPM), so that the valve or nozzle 80 is closed and the coupler has a second bending stiffness (second bending flexibility) such as a maximum bending stiffness (minimum bending flexibility).

At block 135*b*, if the coupler 50 includes an actuator 70 that is reactive to inclination, such as the gravity adjuster 110, the inclination of the drilling assembly is increased or maintained above the selected threshold inclination, so that the valve or nozzle 80 is closed and the coupler has a second bending stiffness (second bending flexibility) such as a maximum bending stiffness (minimum bending flexibility).

At block 136, a second section of the borehole is drilled with the second bending stiffness. Advantageously, this may be a straight section of the borehole. Notably, flexibility may be controlled only by controlling rotation and/or inclination; no communication with the surface such as with processing unit 34 is needed.

The actuator 70 (or actuators 70) automatically adjust the bending stiffness over the course of drilling, as the rotational speed and/or inclination changes. For example, to drill a lateral section, the gravity adjuster 110 provides the maximum stiffness, or the centrifugal governor 90 increases bending stiffness by increasing rotational speed.

The coupler 50 may be used to dampen lateral vibrations. For example, as the pistons 72 alternate and engage the sleeve 64, lateral deformation of the flexible element 62 is transferred to the sleeve 64, creating a flow of hydraulic fluid between them. The flow of the hydraulic fluid provides a damping effect on lateral forces (vibrations). In another example, the valve or nozzle 80 and the actuator 70 (speed controlled or gravity/inclination controlled) may be designed to react on certain drilling parameters (acceleration, inclination, rotary speed) that require damping in lateral direction. Energy for damping of lateral vibrations would be provided by hydraulic losses through the valve or nozzle 80, effectively blocking lateral movements beyond a certain rate.

The coupler 50 may also be used to dampen torsional vibrations. For example, as the flexible element 62 deflects and the pistons contact the sleeve 64, frictional forces arise. Since the sleeve 64 has significantly higher torsional stiffness than the flexible element 62, differential motion between the pistons 72 and the sleeve occurs 64, creating frictional damping at contact between piston and sleeve that counteracts torsional vibrations.

Embodiments described herein may also be suited to act as an isolator for vibrations that may occur during the drilling process and have the potential to significantly impact drilling equipment. Such isolator systems are described and explained, for example, in US Patent Publication No. 20190284882A1, which is incorporated herein by reference in its entirety. Since the flexible element 62 may have a stiffness that is significantly lower than other parts of the BHA 20, the flexible element 62 may ultimately act as an isolator for axial, lateral, and/or torsional vibrations that may occur in BHA 20 during the drilling process. For example, the flexible element 62 may act as an isolator when the control element 68 allows the sleeve 64 to deflect or otherwise move relative to the flexible element 62 (for example, by opening the valve or nozzle 80 to allow pistons 72 to move in response to vibrations and/or bending forces). However, when the valve or nozzle 80 reduces the flow through flow lines 76 to restrict the movement of the pistons 78 and therefore the sleeve 64 relative to the flexible element 62, the stiffness of the coupler 50 increases, which also decreases the isolating effect of vibrations. Hence, in one embodiment, the system described can be used to mitigate the risk of damages to the BHA 20 causes by vibrations, by selectively decreasing the stiffness of the coupler 50.

Figure 10:
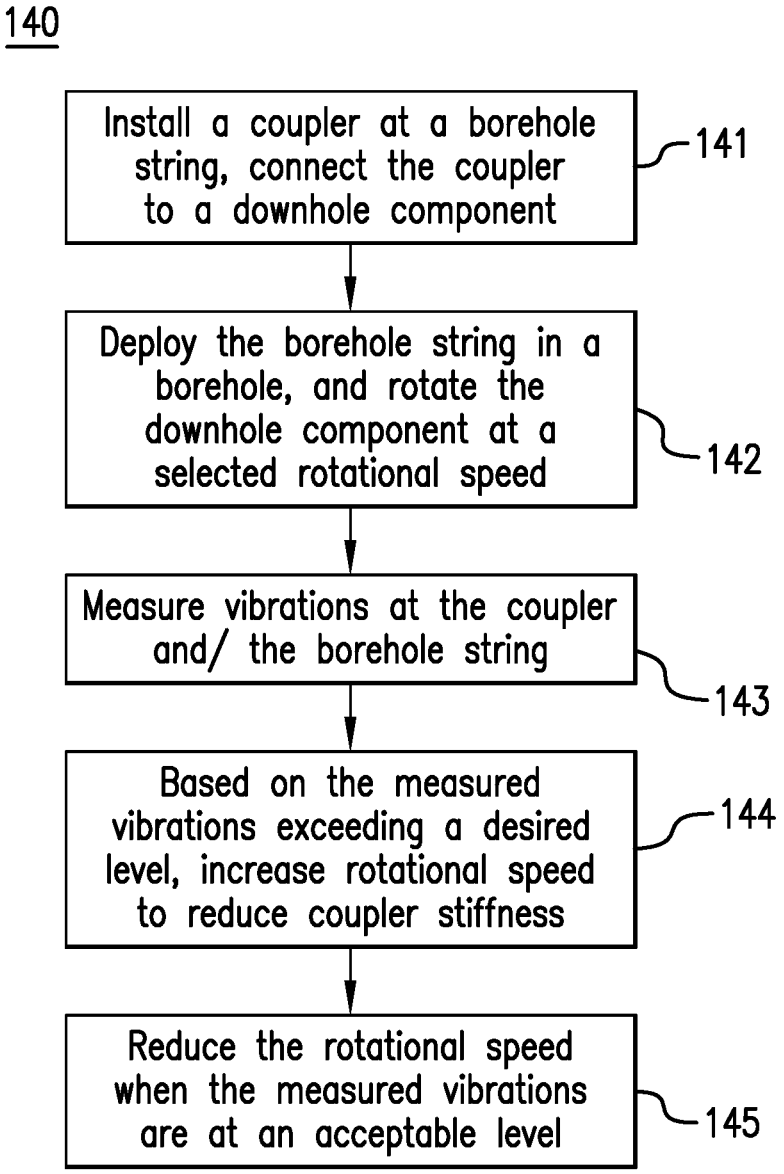
FIG. 10 is a flow diagram depicting an embodiment of a method of performing a subterranean operation, which includes controlling a bending stiffness of a coupler connected to a borehole string.

FIG. 10 illustrates a method 140 of performing a subterranean operation and controlling the bending stiffness of a downhole component or components. The method 140 may be performed in conjunction with the system 10, but is not limited thereto. The method 140 includes steps or stages represented by blocks 141-145. In one embodiment, the method 140 includes the execution of all of the steps or stages in the order described. However, certain steps or stages may be omitted or added, or the order of the steps or stages may be changed.

At block 141, the coupler 50 is installed at a borehole string, such as the drill string 12. For example, the coupler 50 is connected at one end to a downhole component (e.g., the LWD tool 30 or the stabilizer 54) and connected at another end to another downhole component (e.g., the direction control system 32). At block 142, drilling is initiated by rotating a drilling assembly, and a vertical section of a borehole is drilled.

At block 143, a sensor in the drill string 12 measures vibration level and may create data indicative of increased vibration level (such as axial, lateral, and/or torsional vibrations), and compares the vibration level to a reference value, such as a threshold vibration level and/or a rate of change of the vibration level. Vibrations may include axial, lateral, and/or torsional vibrations. Vibration measurements may be sent to the surface equipment 18 (e.g., to processing unit 34).

At block 144, if the vibration level exceeds the reference value or is otherwise indicative of excessive or undesirable vibrations, the rotation speed of the borehole string 14 is adjusted (e.g., reduced or increased) by surface equipment or an electrical or hydraulic actuator is controlled to reduce the stiffness of coupler 50 as described herein, thereby allowing the coupler 50 to isolate the vibrations from other parts of the BHA 20.

At block 145, since vibrations may only occur temporarily, the rotational speed may be re-adjusted or returned to a previous speed when the vibration data indicates that the level of vibrations returns to an acceptable level. If an electrical or hydraulic actuator is used, the actuator is controlled to increase the stiffness. In this way, coupler 50 may be used as an isolator against downhole drilling vibrations and that can be controlled (e.g., switched on or off or increase/decrease its stiffness) while the isolator is in the borehole 14.

Set forth below are some embodiments of the foregoing disclosure:

Embodiment 1: A coupling device configured to be disposed in a borehole string in a borehole in a subterranean region, comprising: a coupler body having a longitudinal axis, the coupler body including an elongated shaft extending along the longitudinal axis and configured to carry loads through the coupling device; a stiffness control device connected to the elongated shaft, the stiffness control device configured to adjust a bending stiffness of the coupler body; and an actuator configured to cause the stiffness control device to adjust the bending stiffness of the coupler body.

Embodiment 2: The coupling device of any prior embodiment, wherein the actuator is configured to react to a change of a force that acts on the coupling device.

Embodiment 3: The coupling device of any prior embodiment, wherein the change of the force is caused by at least one of: a change of an inclination of the coupler body, and a change of a rotational speed of the coupler body.

Embodiment 4: The coupling device of any prior embodiment, wherein the force is a centrifugal force.

Embodiment 5: The coupling device of any prior embodiment, wherein the actuator includes a centrifugal governor operably connected to the stiffness control device.

Embodiment 6: The coupling device of any prior embodiment, wherein the force is a gravitational force.

Embodiment 7: The coupling device of any prior embodiment, wherein the actuator includes a mass configured to move in response to the gravitational force on the mass.

Embodiment 8: The coupling device of any prior embodiment, wherein the coupler body includes a sleeve that surrounds at least a portion of the elongated shaft, and the stiffness control device is configured to adjust the bending stiffness of the coupler body by controlling an extent of a deflection of the elongated shaft relative to the sleeve.

Embodiment 9: The coupling device of any prior embodiment, wherein the stiffness control device is a hydraulic device that includes two or more hydraulic chambers in fluid communication via a hydraulic flow line, and the actuator is configured to control the stiffness control device by actuating a flow control device to change a size of a restriction in the hydraulic flow line.

Embodiment 10: The coupling device of any prior embodiment, wherein the two or more hydraulic chambers comprise three or more hydraulic chambers that are connected by a manifold valve.

Embodiment 11: The coupling device of any prior embodiment, wherein the actuator is configured to transition the flow control device between a first state and a second state, wherein the coupler body has a first level of bending stiffness when the flow control device is in the first state, and the coupler body has a second level of bending stiffness when the flow control device is in the second state, wherein the first level of bending stiffness is less than the second level of bending stiffness, and wherein the restriction is more open in the first state than in the second state.

Embodiment 12: The coupling device of any prior embodiment, wherein the actuator is configured to put the flow control device into a third state, and wherein the restriction is partially open and the coupler body has a third level of bending stiffness that is greater than the first level of bending stiffness and less than the second level of bending stiffness.

Embodiment 13: The coupling device of any prior embodiment, wherein the stiffness control device is a first stiffness control device that controls the extent of the deflection at a first axial position of the sleeve and further comprising a second stiffness control device that controls the extent of the deflection at a second axial position of the sleeve.

Embodiment 14: A method to adjust a bending stiffness of a coupler disposed in a borehole, the method comprising: deploying a borehole string in the borehole in a subterranean region, the borehole string including the coupler, the coupler having a longitudinal axis, the coupler including an elongated shaft extending along the longitudinal axis and configured to carry loads through the coupler, where a stiffness control device is connected to the elongated shaft. The method also includes controlling at least one of an inclination of the coupler and a rotational speed of the coupler, and causing the stiffness control device to adjust the bending stiffness of the coupler in response to the controlling.

Embodiment 15: The method of any prior embodiment, wherein controlling the rotational speed of the coupler includes at least one of: increasing the rotational speed of the coupler to increase the bending stiffness of the coupler, and decreasing the rotational speed of the coupler to decrease the bending stiffness of the coupler.

Embodiment 16: The method of any prior embodiment, wherein controlling the inclination of the coupler includes transitioning an orientation of the coupler from a first inclination of the coupler to a second inclination of the coupler, the transitioning causing the stiffness control device to increase the bending stiffness of the coupler from a first bending stiffness to a second bending stiffness that is greater than the first bending stiffness.

Embodiment 17: The method of any prior embodiment, wherein the stiffness control device is a hydraulic device that includes two or more hydraulic chambers in fluid communication via a hydraulic flow line, and an actuator is configured to control the stiffness control device by actuating a flow control device to change a size of a restriction in the hydraulic flow line.

Embodiment 18: The method of any prior embodiment, wherein the flow control device is transitioned between a first state and a second state by the actuator, wherein the coupler has a first level of bending stiffness when the flow control device is in the first state, and the coupler has a second level of bending stiffness when the flow control device is in the second state, the first level of bending stiffness being less than the second level of bending stiffness, and the restriction being more open in the first state than in the second state.

Embodiment 19: The method of any prior embodiment, wherein the actuating the flow control device includes putting the flow control device into a third state by the actuator, wherein the restriction is more open in the second state and less open than in the first state and the coupler has a third level of bending stiffness that is greater than the first level of bending stiffness and less than the second level of bending stiffness.

Embodiment 20: The method of any prior embodiment, further comprising measuring a vibration level of the borehole string, wherein controlling the at least one of the inclination of the coupler and the rotational speed of the coupler is in response to the measured vibration level.

In connection with the teachings herein, various analyses and/or analytical components may be used, including digital and/or analog systems. The system may have components such as a processor, storage media, memory, input, output, communications link (wired, wireless, pulsed mud, optical or other), user interfaces, software programs, signal processors (digital or analog) and other such components (such as resistors, capacitors, inductors and others) to provide for operation and analyses of the apparatus and methods disclosed herein in any of several manners well-appreciated in the art. It is considered that these teachings may be, but need not be, implemented in conjunction with a set of computer executable instructions stored on a computer readable medium, including memory (ROMs, RAMs), optical (CD-ROMs), or magnetic (disks, hard drives), or any other type that when executed causes a computer to implement the method of the present invention. These instructions may provide for equipment operation, control, data collection and analysis and other functions deemed relevant by a system designer, owner, user or other such personnel, in addition to the functions described in this disclosure.

One skilled in the art will recognize that the various components or technologies may provide certain necessary or beneficial functionality or features. Accordingly, these functions and features as may be needed in support of the appended claims and variations thereof, are recognized as being inherently included as a part of the teachings herein and a part of the invention disclosed.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The terms "about", "substantially" and "generally" are intended to include the degree of error associated with measurement of the particular quantity based upon the equipment available at the time of filing the application. For example, "about" and/or "substantially" and/or "generally" can include a range of ±8% or 5%, or 2% of a given value.

The teachings of the present disclosure may be used in a variety of well operations. These operations may involve using one or more treatment agents to treat a formation, the fluids resident in a formation, a borehole, and/or equipment in the borehole, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A coupling device configured to be disposed in a borehole string in a borehole in a subterranean region, comprising:

a coupler body having a longitudinal axis, the coupler body including an elongated shaft extending along the longitudinal axis and configured to carry loads through the coupling device;

a stiffness control device connected to the elongated shaft, the stiffness control device configured to adjust a bending stiffness of the coupler body; and an actuator configured to cause the stiffness control device to adjust the bending stiffness of the coupler body, wherein:

the actuator is configured to react to a change of a force that acts on the coupling device, the force being at least one of a gravitational force due to a change of an inclination of the coupler body and a change of a centrifugal force due to a change of a rotational speed of the coupler body; or the stiffness control device is a hydraulic device that includes two or more hydraulic chambers in fluid communication via a hydraulic flow line, and the actuator is configured to control the stiffness control device by actuating a flow control device to change a size of a restriction in the hydraulic flow line.

2. The coupling device of claim 1, wherein the actuator is configured to react to both the change of the gravitational force due to the change of the inclination of the coupler body and the change of the centrifugal force due to the change of the rotational speed of the coupler body.

3. The coupling device of claim 1, wherein the hydraulic device includes one or more movable pistons in at least one of the hydraulic chambers, the at least one of the hydraulic chambers shaped to maintain a fluid tight seal between the one or more movable pistons and the at least one of the hydraulic chambers.

4. The coupling device of claim 1, wherein the actuator is configured to control the stiffness control device by actuating the flow control device in response to the force that acts on the coupling device to change the size of the restriction in the hydraulic flow line.

5. The coupling device of claim 1, wherein the actuator includes a centrifugal governor operably connected to the stiffness control device.

6. The coupling device of claim 1, wherein the actuator is configured to adjust the bending stiffness of the coupler body in a gradual manner.

7. The coupling device of claim 1, wherein the actuator includes a mass configured to move in response to the gravitational force on the mass.

8. The coupling device of claim 1, wherein the coupler body includes a sleeve that surrounds at least a portion of the elongated shaft, and the stiffness control device is configured to adjust the bending stiffness of the coupler body by controlling an extent of a deflection of the elongated shaft relative to the sleeve.

9. The coupling device of claim 8, wherein the elongated shaft has a first end that is fixedly attached to or integral with the sleeve, and a second end that contacts the stiffness control device.

10. The coupling device of claim 1, wherein the two or more hydraulic chambers comprise three or more hydraulic chambers that are connected by a manifold valve.

11. The coupling device of claim 1, wherein the actuator is configured to transition the flow control device between a first state and a second state, wherein the coupler body has a first level of bending stiffness when the flow control device is in the first state, and the coupler body has a second level of bending stiffness when the flow control device is in the second state, wherein the first level of bending stiffness is less than the second level of bending stiffness, and wherein the restriction is more open in the first state than in the second state.

12. The coupling device of claim 11, wherein the actuator is configured to put the flow control device into a third state, and wherein the restriction is partially open and the coupler body has a third level of bending stiffness that is greater than the first level of bending stiffness and less than the second level of bending stiffness.

13. The coupling device of claim 8, wherein the stiffness control device is a first stiffness control device that controls the extent of the deflection at a first axial position of the sleeve and further comprising a second stiffness control device that controls the extent of the deflection at a second axial position of the sleeve.

14. A method to adjust a bending stiffness of a coupler disposed in a borehole, the method comprising:

deploying a borehole string in the borehole in a subterranean region, the borehole string including the coupler, the coupler having a longitudinal axis, the coupler including an elongated shaft extending along the longitudinal axis and configured to carry loads through the coupler, wherein a stiffness control device is connected to the elongated shaft, and an actuator is configured to cause the stiffness control device to adjust the bending stiffness of the coupler body, wherein:

the actuator is configured to react to a change of a force that acts on the coupler, the force being at least one of a gravitational force due to a change of an inclination of the coupler body and a change of a centrifugal force due to a change of a rotational speed of the coupler body; or the stiffness control device is a hydraulic device that includes two or more hydraulic chambers in fluid communication via a hydraulic flow line, and the actuator is configured to control the stiffness control device by actuating a flow control device to change a size of a restriction in the hydraulic flow line;

controlling at least one of the inclination of the coupler and the rotational speed of the coupler; and causing the stiffness control device to adjust the bending stiffness of the coupler in response to the controlling.

15. The method of claim 14, wherein controlling the rotational speed of the coupler includes at least one of: increasing the rotational speed of the coupler to increase the bending stiffness of the coupler, and decreasing the rotational speed of the coupler to decrease the bending stiffness of the coupler.

16. The method of claim 14, wherein controlling the inclination of the coupler includes transitioning an orientation of the coupler from a first inclination of the coupler to a second inclination of the coupler, the transitioning causing the stiffness control device to increase the bending stiffness of the coupler from a first bending stiffness to a second bending stiffness that is greater than the first bending stiffness.

17. The method of claim 14, wherein the actuator is configured to control the stiffness control device by actuating the flow control device in response to the force that acts on the coupler to change the size of the restriction in the hydraulic flow line.

18. The method of claim 14, wherein the flow control device is transitioned between a first state and a second state by the actuator, wherein the coupler has a first level of bending stiffness when the flow control device is in the first state, and the coupler has a second level of bending stiffness when the flow control device is in the second state, the first level of bending stiffness being less than the second level of bending stiffness, and the restriction being more open in the first state than in the second state.

19. The method of claim 18, wherein the actuating the flow control device includes putting the flow control device into a third state by the actuator, wherein the restriction is more open in the second state and less open than in the first state and the coupler has a third level of bending stiffness that is greater than the first level of bending stiffness and less than the second level of bending stiffness.

20. The method of claim 14, further comprising measuring a vibration level of the borehole string, wherein controlling the at least one of the inclination of the coupler and the rotational speed of the coupler is in response to the measured vibration level.

* * * * *